United States Patent [19]

Véga et al.

[11] Patent Number: 4,698,108

[45] Date of Patent: Oct. 6, 1987

[54] CASTABLE SMOKE-GENERATING COMPOUNDS EFFECTIVE AGAINST INFRARED

[75] Inventors: Jean F. Véga, Bourges; Philippe C. Morand, Mehun/Yevre, both of France

[73] Assignee: Etat Francais, France

[21] Appl. No.: 869,894

[22] Filed: Jun. 3, 1986

[30] Foreign Application Priority Data

Jun. 7, 1985 [FR] France ..... 85 08603

[51] Int. Cl.[4] ..... C06B 45/02

[52] U.S. Cl. ..... 149/21; 149/2; 149/87; 149/110; 149/114

[58] Field of Search ..... 149/2, 21, 87, 110, 149/114

[56] References Cited

U.S. PATENT DOCUMENTS 1,318,074 10/1919 Gowdy ..... 149/87

3,770,525 11/1973 Villey-Desmeserets et al. .... 149/87

3,983,816 10/1976 Cornia et al. ..... 149/87

*Primary Examiner*—Stephen J. Lechert, Jr.

*Attorney, Agent, or Firm*—Parkhurst & Oliff

[57] ABSTRACT

The invention concerns a castable pyrotechnic composition used to produce opaque smoke for impeding the transmission of infrared radiation from a target to a sensor, of the type including a compound generating carbon particles whose dimensions are between 1 and 14 μm.

The composition includes a condensed halogenated carbon compound with a melting point between 75° C. and 120° C., with a halogenation ratio greater than 3, such as chloronaphthalene, a fluoro carbon compound such as vinylidene polyfluoride, and a metal powder such as magnesium, reacting together at a temperature of the order of 1500° C.

Application is in camouflaging targets emitting infrared radiation.

8 Claims, No Drawings

CASTABLE SMOKE-GENERATING COMPOUNDS EFFECTIVE AGAINST INFRARED

BACKGROUND OF THE INVENTION

A. FIELD OF THE INVENTION

The technical field of the present invention is that of meltable smoke-producing pyrotechnic compositions with which any target can be camouflaged by impeding the transmission of the infrared radiation the target emits.

B. DESCRIPTION OF THE PRIOR ART

There currently exist few published works on the production of wide-band smoke screens, i.e. effective throughout the visible wavelengths down to the far infrared from 0.4 to 14 μm.

Smoke-producing pyrotechnic compositions based on hexachloroethane as an oxidizer with zinc oxide as reducer are well known in the trade and as an illustration we can refer to U.S. Pat. No. 2,939,779. This type of composition produces a white screen that is ineffective against infrared detectors operating in the atmospheric windows of transparency, which are 3 to 5 μm and 7 to 14 μm.

The use of an aerosol of fine droplets or solid particles has already been proposed to stop infrared radiation. However, the resulting screens are very sensitive to the atmospheric conditions (wind and relative humidity in the case of metal cholorides) and they do not remain effective very long. As an example, we can refer to French Pat. No. 2,299,617 and French Pat. No. 2,309,828.

The French Pat. No. 2,560,186 is also known, which proposes a pyrotechnic composition for producing a smoke that is opaque to the infrared radiation from a target toward a heat sensor, wherein the smoke contains a component which, by thermal decomposition, generates particles of carbon ranging in size between 1 and 14 μm, an oxidizer-reducer system reacting at a temperature above 1000° C., and a binder.

This type of composition may include the following ternary system:

15 to 25 parts by weight of a metal powder, such as magnesium, 15 to 85 parts by weight of hexachlorobenzene or hexachloroethane (oxidizer), 0 to 30 parts of naphthalene (carbon generator).

With the exception of the phosphorous that is cast to shape, but is ineffective in infrared, the smoke-producing compositions are usually powder mixtures formed under compression. These materials do not always offer the optimum mechanical properties, are difficult to machine for low compression ratios and are manufactured on a unit basis. The manufacturing process requires heavy equipment such as blenders, mixers, driers and presses that make it impossible to manufacture products of large dimensions. The fabrication process is complex and the unit price is high.

Furthermore, the smoke-producing pyrotechnic compositions used in producing a smoke screen against infrared radiation transmission include the following components:

a reducer (most often magnesium powder)

an oxidizer (hexachloroethane or hexachlorobenzene)

a carbon generator (naphthalene, anthracene)

a fluorinated binder (vinylidene polyfluoride).

These compositions exhibit two disadvantages:

Hexachlorobenzene, because of its toxicity, is no longer commercially available on European markets.

Aside from the manufacturing problems mentioned above, these compositions require mixing at least four components.

SUMMARY OF THE INVENTION

Accordingly, the present invention provides a pyrotechnic composition producing a screen comprising carbon particles to make a target undetectable by a receiver or missile sensor, but which can be constructed by simple casting. The object of the invention is thus a castable pyrotechnic composition designed for producing opaque smoke to prohibit the transmission of infrared radiation from a target toward a sensor, of the type including a compound generating carbon particles having dimensions between 1 and 14 μm, wherein it includes an halogenated condensed carbon compound with a melting point between 75° and 120° C., with a halogenation ratio greater than 3, a fluorinated carbon compound and a metal powder reacting together at a temperature of the order of 1500° C.

DETAILED DESCRIPTION OF THE INVENTION

Advantageously, the carbon compound can be represented by chlorinated naphthalene, the fluorinated compound by vinylidene polyfluoride and the metal powder by magnesium.

The composition may contain 50 to 90 parts by weight of carbon compound, 8 to 10 parts by weight of vinylidene polyfluoride and 15 to 25 parts by weight of metal powder.

According to the invention, the pyrotechnic composition meets the three following criteria:

a high combustion rate a combustion environment lean in oxygen the presence in the composition of a compound with condensed nodules.

The condensed nodules may advantageously carry halogen atoms (fluorine, chlorine) and/or exhibit the highest possible ratio in the number of carbon atoms to the number of hydrogen atoms. The presence of these condensed nodules in association with the first two criteria is then used to generate carbon forming a screen of particles with wide spectrum. In effect, the presence of oxygen along with an unfavorable C/H ratio will cause formation of gas molecules ($CO_2$ and $H_2O$) that are transparent in the visible and infrared ranges.

In the pyrotechnic composition, the oxidizer is then the chlorine or fluorine, carried by another molecule generating acid which, by condensing on the atmospheric water vapor, forms an aerosol of solid particles that are effective against sensors in the visible spectrum.

The oxidizer compound generating carbon particles may be industrial chlorinated naphthalene, called clonacire, which has a chlorine substitution level between 3.4 and 3.6. Two CLONACIRE products are commercially available: clonacire 90 and CLONACIRE 150 with melting points of 90° C. and 150° C., respectively. The size of the carbon particles is between 1 and 15 μm.

One advantage of the pyrotechnic composition and of the smoke-producing munition according to the invention resides in the fact that the cloud of smoke, opaque in infrared, consists of fine carbon particles generated by homogenous chemical process with a sufficient rate of flow.

Another advantage resides in the fact that it is possible to control the essential factors:

the combustion rate of the composition, so that an adequate mass rate of flow can be obtained the combustion temperature, which must be high and which determines the proper grain size distribution of the carbon particles.

Another advantage resides in the fact that these compositions can be cast or extruded. In effect, by offering a family of compositions with melting points between 75° and 120° C., a dual objective is achieved; economy by saving on costs and a technological objective by being able to fill complicated geometric shapes. These compositions lend themselves better to modern industrial processes and their advantages are obvious:

compression is eliminated as a means of fabrication (although these compositions can, if desired, be shaped by compression)

the possibility of casting large diameter blanks to supply generators for area defense, which is impossible with compressed compositions.

optimum density good machinability good impact strength.

The mechanical behavior of these compositions is particularly advantageous. A creep is observed in extrusion that prevents any decohesion of the material. This is due to the presence of the wax-like clonacire products that endow these compositions with a visco-elastic behavior that is not found in the compositions described in French Pat. No. 2,560,186.

Another advantage is that fibers of chemical origin can be incorporated in the composition that have a carbon structure and which, by pyrolysis at high temperature, generate carbon particles creating a screen.

Finally, the total composition can be obtained by mixing only three components: the reducer, the chlorinated naphthalene and the vinylidene polyfluoride.

The pyrotechnic compositions, according to the invention, are prepared as follows:

The metal powder is first baked at approximately 50° C. for 24 hours.

The meltable carbon compound is then placed in the reactor and is heated under agitation up to a temperature 15° C. above the melting level. The vinylidene polyfluoride and the reducer are then added in succession and the whole is held at the melting temperature for some ten minutes, under agitation, to thoroughly homogenize the mixture. The casting can then be done. The cast blanks are then machined to eliminate the shrinkage holes. These blanks can then be filled with smoke devices, in the center channel provided at casting.

For each of the compositions mentioned hereafter, the combustion rate, mechanical strength, screening power and absorption coefficient have been measured.

The combustion rate is measured on a cylindrical specimen 3 cm long and 3 cm in diameter, fabricated by compression under $6\times10^7$ Pa.

The screening power is measured with two thermal cameras operating in the 3–5 and 8–12 μm bands, located 4.5 m from an emitter constituting a source 20 cm on a side and raised to a temperature of 200° C., placed in a tunnel. The screening power of the smoke can be defined as the time during which the image of the source is partially or totally obscured by the passage of this smoke between the camera and the source.

The absorption coefficient A $\Delta\lambda$ ($m^{-1}$) is measured in two wavelength bands from 7.65 to 13.2 μm and from 3.3 to 4.2 μm, by application of Beer's law.

Table 1 lists the combustion rate and the mechanical strength measurements defined below:

Combustion: The combustion rate M in open air, V (1 atm), and the combustion rate under the pressure inside a smoke device, V (P), ready for use, i.e. consisting of a smoke device 36 cm long and 8 cm in diameter.

Mechanical strength. The maximum compressive force Smc (in Pa) is measured along with the compression emc due to this force, and Young's modulus (Ec).

Coefficients of sensitivity to friction (CsF) and impact (CsI) are measured according to the known procedures used in this technical field.

As examples, the following various compositions were fabricated in the form of blanks according to the above indications and were tested as specified above, along with a reference composition described according to example 1 in French Patent No. 2,560,186.

COMPOSITION 1

25 parts of magnesium
70 parts of CLONACIRE 90
15 parts of vinylidene polyfluoride.

COMPOSITION 2

25 parts of magnesium
70 parts of CLONACIRE 115
15 parts of vinylidene polyfluoride.

COMPOSITION 3

25 parts of magnesium
70 parts of CLONACIRE 115
15 parts of vinylidene polyfluoride
2 parts of carbon fibers.

COMPOSITION 4

17 parts of magnesium
70 parts of CLONACIRE 115
13 parts of vinylidene polyfluoride.

TABLE 1

| Criteria | |
|---|---|
| V (1 atm) (mm/s) | 0.6 |
| VP (mm/s) | 1 |
| CsF (%) at 353 N | 0 |
| CsI (%) at 100 J | 0 |

TABLE 2

| Compositions | Smc ($10^5$ Pa) | emc (%) | Ec ($10^5$ Pa) |
|---|---|---|---|
| 1 | 24.5 | 1.22 | 2020 |
| 2 | 42.5 | 1.29 | 3360 |
| Reference | 178 | 0.87 | 3000 |

A free creep (without stress) is observed, showing that compositions 1 and 2 are not subject to cracking. Similar results are achieved with compositions 3 and 4.

The results given below in tables 3 and 4 are achieved under the same experimental conditions, in a tunnel with a laminar flow of the generated smoke.

| | |
|---|---|
| mass of smoke-producing composition | 1.5 to 1.7 kg |
| diameter of device | 80 mm |
| wind | 1.20 m/s |
| smoke generated 21 cm from the line | |

-continued

| | |
|---|---|
| of measurement | |
| sectional area of the smoke tunnel | 1 $m^2$ |
| optical path d | 1 m |

The screening power results from the color processing of a thermal image and is expressed in seconds.

This is the time during which the attenuation of the signal is greater than a given percentage in the band considered. The absorption coefficient A $\Delta\lambda$, found by spectroradiometry, expresses the screening capacity of a given smoke for a very short time interval, but is not representative of the anti-infrared power with the time.

TABLE 3

| | | (7.65 to 13.2 μm) | | | | |
|---|---|---|---|---|---|---|
| | AΔλ | Screening power (s) | | | | |
| Composition | ($m^{-1}$) | >28.6% | >42.8% | >57.1% | >71.4% | >85.7% |
| 1 casting | 0.53 | 70 | 28 | — | — | — |
| 2 casting | 0.475 | 69 | 17 | — | — | — |
| 3 casting | 0.54 | 34 | 7 | — | — | — |
| 4 casting | 0.83 | 63 | 28 | 5 | — | — |
| Ref. | 0.62 | 69 | 34 | 8 | — | — |

TABLE 4

| | | (3.3 to 4.2 um) | | | | |
|---|---|---|---|---|---|---|
| | A | Screening power (s) | | | | |
| Composition | ($m^{-1}$) | >28.6% | >42.8% | >57.1% | >71.4% | >85.7% |
| 1 casting | 1.21 | 97 | 71 | 51 | — | — |
| 2 casting | 1.03 | 102 | 70 | 38 | — | — |
| 3 casting | 1.08 | 78 | 38 | 17 | — | — |
| 4 casting | 1.57 | 110 | 74 | 51 | 19 | 4 |
| Ref. | 1.67 | 105 | 71 | 48 | 19 | 4 |

It can be seen that composition 4 has excellent infrared capabilities. Its optimum density and low rate of combustion make it a likely candidate for fabricating bulk smoke-devices more than 120 mm wide.

What we claim is:

1. A castable pyrotechnic composition for producing opaque smoke for impeding the transmission of infrared radiation from a target to a sensor, consisting essentially of a condensed halogenated carbon compound with a melting point between 75° C. and 120° C. and having a halogenation ratio greater than 3, a fluorinated carbon compound and a metal powder, wherein the composition produces carbon particles having dimensions between 1 and 14 μm and reacts at a temperature of about 1500° C.

2. A pyrotechnic composition as claimed in claim 1, wherein said halogenated carbon compound is chloronaphthalene, said fluorinated carbon compound is vinylidene polyfluoride and said metal powder is magnesium.

3. A pyrotechnic composition as claimed in claim 2, wherein the composition consists essentially of 50 to 90 parts by weight of said chloronaphthalene, 8 to 20 parts by weight of said vinylidene polyfluoride and 15 to 25 parts by weight of said magnesium.

4. A pyrotechnic composition as claimed in claim 3, wherein the composition consists essentially of 70 parts by weight of said chloronaphthalene, 15 parts by weight vinylidene polyfluoride and 25 parts by weight magnesium.

5. A pyrotechnic composition as claimed in claim 3, wherein the composition consists essentially of 70 parts by weight chloronaphthalene, 15 parts by weight vinylidene polyfluoride and 17 parts by weight magnesium.

6. A pyrotechnic composition as claimed in claim 3, further consisting essentially of fibers of carbon compounds.

7. A pyrotechnic composition as claimed in claim 6, wherein said fibers are selected from the group consisting of polyamides, nylon and carbon.

8. A pyrotechnic composition as claimed in claim 7, wherein the composition consists essentially of 70 parts by weight chloronaphthalene, 15 parts by weight vinylidene polyfluoride, 25 parts by weight magnesium and 2 parts by weight carbon fibers.

* * * * *